US011421401B2

(12) United States Patent
Wu et al.

(10) Patent No.: US 11,421,401 B2
(45) Date of Patent: Aug. 23, 2022

(54) SYSTEM AND METHOD FOR CONTROLLING WORK VEHICLE IMPLEMENTS DURING IMPLEMENT SHAKE OPERATIONS

(71) Applicant: CNH Industrial America LLC, New Holland, PA (US)

(72) Inventors: Duqiang Wu, Bolingbrook, IL (US); Navneet Gulati, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 393 days.

(21) Appl. No.: 16/750,540

(22) Filed: Jan. 23, 2020

(65) Prior Publication Data

US 2021/0230838 A1 Jul. 29, 2021

(51) Int. Cl.

| | |
|---|---|
| ***E02F 9/22*** | (2006.01) |
| ***E02F 3/28*** | (2006.01) |
| ***E02F 3/43*** | (2006.01) |
| ***E02F 9/26*** | (2006.01) |

(52) U.S. Cl.

CPC ..... *E02F 9/221* (2013.01); *E02F 3/283* (2013.01); *E02F 3/431* (2013.01); *E02F 9/265* (2013.01)

(58) Field of Classification Search

CPC . E02F 3/283; E02F 3/431; E02F 9/221; E02F 9/265

See application file for complete search history.

(56) References Cited

U.S. PATENT DOCUMENTS

| | | | | |
|---|---|---|---|---|
| 5,224,033 | A | 6/1993 | Nakamura et al. | |
| 5,832,730 | A * | 11/1998 | Mizui | E02F 9/2207 91/361 |
| 6,757,992 | B1 * | 7/2004 | Berger | E02F 3/405 701/50 |
| 7,866,149 | B2 | 1/2011 | Brinkman et al. | |
| 10,316,929 | B2 | 6/2019 | Wang et al. | |
| 2006/0272325 | A1 * | 12/2006 | Moon | F15B 21/087 60/426 |

(Continued)

FOREIGN PATENT DOCUMENTS

| | | |
|---|---|---|
| EP | 2674533 | 12/2013 |
| JP | 10088623 | 4/1998 |

*Primary Examiner* — Tyler J Lee

(74) *Attorney, Agent, or Firm* — Rickard K. DeMille; Rebecca L. Henkel

(57) ABSTRACT

A system for controlling the operation of a work vehicle implement during an implement shake operation may include an implement configured to pivotably coupled to a loader arm. A controller may be configured to monitor an angle of the implement relative to the arm during the implement shake operation. Furthermore, the controller may be configured to determine first and second differentials between monitored angles of the implement during first and second cycles of the implement shake operation, respectively, and a predetermined average implement angle. Additionally, the controller may be configured to determine an estimated differential between an anticipated angle of the implement during a third cycle of the implement shake operation and the predetermined angle based on the first and second differentials. Furthermore, the controller may be configured to adjust a duty cycle and/or an amplitude of the third cycle of the implement shake operation based on the estimated differential.

20 Claims, 4 Drawing Sheets

(56) References Cited

U.S. PATENT DOCUMENTS

| | | | | |
|---|---|---|---|---|
| 2015/0240446 | A1* | 8/2015 | Takaura | E02F 3/435<br>137/636.1 |
| 2021/0148084 | A1* | 5/2021 | Ashby | G05D 1/0225 |

* cited by examiner

SYSTEM AND METHOD FOR CONTROLLING WORK VEHICLE IMPLEMENTS DURING IMPLEMENT SHAKE OPERATIONS

FIELD OF THE INVENTION

The present disclosure generally relates to work vehicles and, more particularly, to systems and method for controlling the operation of an implement of a work vehicle during an implement shake operation based on the position of the implement relative to a loader arm of the vehicle.

BACKGROUND OF THE INVENTION

Work vehicles having loader arms, such as wheel loaders, skid steer loaders, backhoe loaders, compact track loaders, and the like, are a mainstay of construction work and industry. For example, wheel loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arms, which allows the wheel loader to be used to carry supplies or particulate matter, such as gravel, sand, or dirt, around a worksite. Typically, the bucket of a wheel loader is pivotally coupled to the loader arms to allow the implement to be pivoted or tilted relative to the loader arms across a plurality of positions. For instance, the implement may be titled between a maximum rollback or curl position (e.g., at which the open portion of the bucket is facing upward) and a maximum dump position (e.g., at which the open portion of the bucket is facing downward).

During operation of a wheel loader or other work vehicle of similar construction, a need arises every so often to rapidly move the implement back and forth relative to the loader arms (e.g., to shake the implement). For instance, an operator may desire to shake the implement to remove dirt, debris, or other materials that have accumulated or otherwise become stuck on the implement. However, in certain instances, the implement shake operation may cause the loader to vibrate, which may be uncomfortable for vehicle operator and/or interfere with the operation of the loader.

Accordingly, an improved system and method for controlling the operation of work vehicle implements would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a system for controlling a work vehicle implement during an implement shake operation. The system may include a loader arm and an implement coupled to the loader arm, with the implement configured to pivot relative to the loader arm between a maximum rollback position and a maximum dump position. Furthermore, the system may also include a sensor configured to capture data indicative of an angle of the implement relative to the loader arm and a controller communicatively coupled to the sensor. As such, the controller may be configured to monitor the angle of the implement relative to the loader arm as the implement is pivoted relative to the loader arm during the implement shake operation based on data received from the sensor. Additionally, the controller may be configured to determine a first differential between a monitored angle of the implement during a first cycle of the implement shake operation and a predetermined average implement angle. Moreover, the controller may be configured to determine a second differential between a monitored angle of the implement during a second cycle of the implement shake operation and a predetermined average implement angle. In addition, the controller may be configured to determine an estimated differential between an anticipated angle of the implement during a third cycle of the implement shake operation and the predetermined average implement angle based on the first and second differentials, with the third cycle occurring after the first and second implement cycles. Furthermore, the controller may be configured to adjust at least one of a duty cycle or an amplitude of the implement shake operation based on the estimated differential.

In another aspect, the present subject matter is directed to a method for controlling an implement of a work vehicle during an implement shake operation. The implement may be pivotably coupled to a loader arm of the work vehicle. The method may include monitoring, with one or more computing devices, an angle of the implement relative to the loader arm as the implement is pivoted relative to the loader arm between a maximum rollback position and a maximum dump position during the implement shake operation. Additionally, the method may include determining, with the one or more computing devices, a first differential between a monitored angle of the implement during a first cycle of the implement shake operation and a predetermined average implement angle. Furthermore, the method may include determining, with the one or more computing devices, a second differential between a monitored angle of the implement during a second cycle of the implement shake operation and the predetermined average implement angle. Moreover, the method may include determining, with the one or more computing devices, an estimated differential between an anticipated angle of the implement during a third cycle of the implement shake operation and the predetermined average implement angle based on the first and second differentials, with the third cycle occurring after the first and second implement cycles, In addition, the method may include adjusting, with the one or more computing devices, at least one of a duty cycle or an amplitude of the implement shake operation based on the estimated differential.

These and other features, aspects and advantages of the present technology will become better understood with reference to the following description and appended claims. The accompanying drawings, which are incorporated in and constitute a part of this specification, illustrate embodiments of the technology and, together with the description, explain the principles of the technology.

BRIEF DESCRIPTION OF THE DRAWINGS

A full and enabling disclosure of the present technology, including the best mode thereof, directed to one of ordinary skill in the art, is set forth in the specification, which refers to the appended figures, in which.

Figure 1:
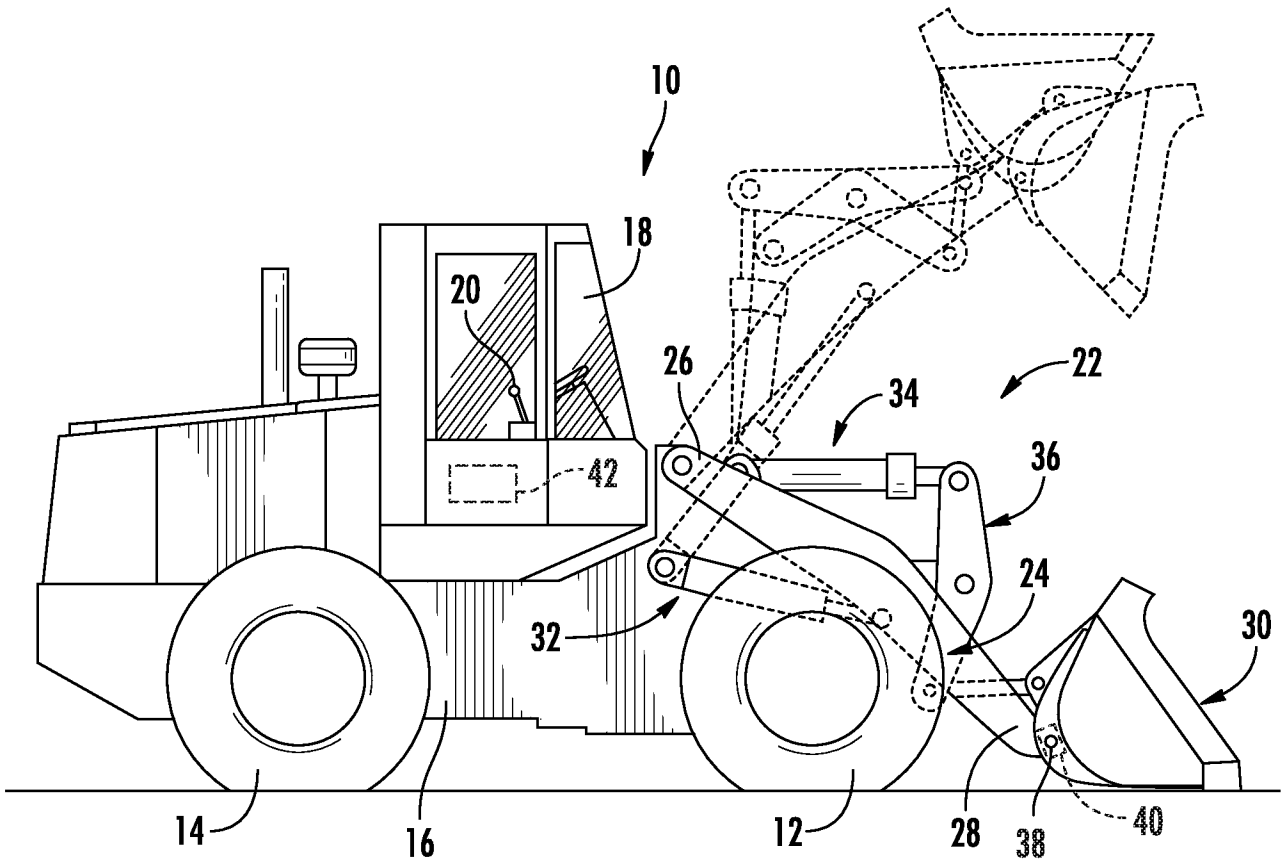
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for controlling an implement of a work vehicle during an implement shake operation. As will be described below, the present subject matter may be used with a front loader or any other work vehicle having loader arms and an implement (e.g., a bucket) pivotably coupled to the loader arms such that the implement is movable between a maximum rollback or curl position (e.g., at which the open portion of the bucket is facing upward) and a maximum dump position (e.g., at which the open portion of the bucket is facing downward). In this respect, during an implement shake operation, the implement may be moved rapidly between the maximum rollback and dump positions for several cycles to remove dirt, debris, or other materials that have accumulated or otherwise become stuck on the implement.

In several embodiments, to execute an implement shake operation, one or more valves associated with the hydraulic cylinder(s) coupled between the implement and the loader arms may be controlled via pulse width modulation (PWM). More specifically, for a given cycle of the implement shake operation, the valve(s) may be in a rod retraction configuration a first portion of the given cycle such that rods of the hydraulic cylinder(s) are retracted in a manner that moves the implement to one of the maximum rollback or dump positions. Thereafter, the valve(s) may be adjusted to a rod extension configuration for a second portion of the given cycle such that the rods of the hydraulic cylinder(s) are retracted in a manner that moves the implement to the other of the maximum rollback or dump positions. The relative portions of the given implement that the valve(s) are in the rod retraction and extension configurations may be controlled based on a duty cycle of the implement shake operation.

In accordance with aspects of the present subject matter, the disclosed systems and methods may be used to control the duty cycle and/or the amplitude of the implement shake operation to prevent the implement shake operation from vibrating the vehicle in a manner that is uncomfortable for the operator or interferes with the operation of the vehicle. Specifically, in several embodiments, a controller of the disclosed system may be configured to monitor the angle of the implement relative to the loader arms during the implement shake operation. In this respect, the controller may be configured to determine a first differential between the average monitored angle during a first cycle of the implement shake operation and a predetermined average implement angle. The predetermined average implement angle may, in turn, be associated an implement shake operation that does not incite vibrations that are uncomfortable for the operator or interfere with the vehicle operation. Furthermore, the controller may be configured to determine a second differential between the average monitored angle during a second cycle of the implement shake operation and the predetermined average implement angle. Moreover, the controller may be configured to determine an estimated differential between an anticipated average angle of the implement during a third cycle (e.g., the cycle immediately following the second cycle) of the implement shake operation and the predetermined average implement angle based on the first and second differentials. For example, the controller may determine the estimated differential by extrapolating the determined first and second differentials. Thereafter, the controller may be configured to adjust (e.g., increase or decrease) the duty cycle and/or the amplitude of the implement shake operation during the third cycle based on the estimated differential such that the monitored average angle of the implement during a fourth cycle (e.g., the cycle immediately following the third cycle) of the implement shake operation is returned to the predetermined average angle value.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other work vehicle including movable loader arms (e.g., any other type of front loader, such as skid steer loaders, backhoe loaders, compact track loaders and/or the like).

As shown in FIG. 1, the work vehicle 10 includes a pair of front wheels 12, a pair or rear wheels 14 and a chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10. For instance, as shown in FIG. 1, the work vehicle 10 may include one or more control levers 20 for controlling the operation of one or more components of a lift assembly 22 of the work vehicle 10.

As shown in FIG. 1, the lift assembly 22 may include a pair of loader arms 24 (one of which is shown) extending lengthwise between a first end 26 and a second end 28, with the first ends 26 of the loader arms 24 pivotably coupled to the chassis 16 and the second ends 28 of the loader arms 24 pivotably coupled to a suitable implement 30 of the work vehicle 10 (e.g., a bucket, fork, blade, and/or the like). In addition, the lift assembly 22 also includes a plurality of actuators for controlling the movement of the loader arms 24 and the implement 30. For instance, the lift assembly 22 may include a pair of hydraulic lift cylinders 32 (one of which is shown) coupled between the chassis 16 and the loader arms 24 for raising and lowering the loader arms 24 relative to the ground. Moreover, the lift assembly 22 may include a pair of hydraulic tilt cylinders 34 (one of which is shown) for tilting or pivoting the implement 30 relative to the loader arms 24. For example, the hydraulic tilt cylinders 34 may be configured to pivot the implement 30 between a maximum rollback or curl position (e.g., at which the open portion of the bucket is facing upward) and a maximum dump position (e.g., at which the open portion of the bucket is facing downward). As shown in the illustrated embodiment, each tilt cylinder 34 may, for example, be coupled to the implement 30 via a linkage or lever arm 36. In such an embodiment, extension or retraction of the tilt cylinders 34 may result in the lever arm 36 pivoting about a pivot joint 38 to tilt the implement 30 relative to the loader arms 24.

Furthermore, in several embodiments, the work vehicle 10 may include an implement angle sensor 40. In general, the implement angle sensor 40 may be configured to capture data indicative of the angle or orientation of the implement 30 relative to the loader arms 24. For example, in one embodiment, the implement angle sensor 40 may correspond to a potentiometer positioned between the implement 30 and the loader arms 24, such as within the pivot joint 38. In such an embodiment, as the implement 30 is moved between the maximum rollback and dump positions, the voltage output by the implement angle sensor 40 may vary, with such voltage being indicative of the angle of the implement 30 relative to the loader arms 24. However, in other embodiments, the implement angle sensor 40 may correspond to any other suitable sensor(s) and/or sensing device(s) configured to capture data associated with the angle or orientation of the implement 30 relative to the loader arms 24, such as a Hall Effect sensor.

Additionally, the work vehicle 10 may include one or more acceleration sensors 42. In general, the acceleration sensor(s) 42 may be configured to capture data indicative of the movement or motion (e.g., vibrations) of the cab 18 of the vehicle 10 or more or more components positioned within the cab 18. Specifically, in one embodiment, the acceleration sensor(s) 42 may correspond to a gyroscope(s) or an inertial measurement unit(s) (IMU(s)) positioned within the cab 18. For example, in such an embodiment, the acceleration sensor(s) 42 may be provided in operative association with an operator's seat (not shown) positioned within the cab 18. As such, the acceleration sensor(s) 42 may be configured to capture data indicative of the vibrations or other movement/motion of the seat. In this respect, seat vibrations/motion that are uncomfortable to the operator or otherwise interferes with the operation of the vehicle 10 can be detected. However, in other embodiments, the acceleration sensor(s) 42 may correspond to any other suitable sensor(s) and/or sensing device(s) configured to capture data associated with the motion/movement of the cab 18 or components position within the cab 18.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, the work vehicle 10 was described above as including a pair of lift cylinders 32 and a pair of tilt cylinders 34. However, in other embodiments, the work vehicle 10 may, instead, include any number of lift cylinders 32 and/or tilt cylinders 24, such as by only including a single lift cylinder 32 for controlling the movement of the loader arms 24 and/or a single tilt cylinder 34 for controlling the movement of the implement 30.

Figure 2:
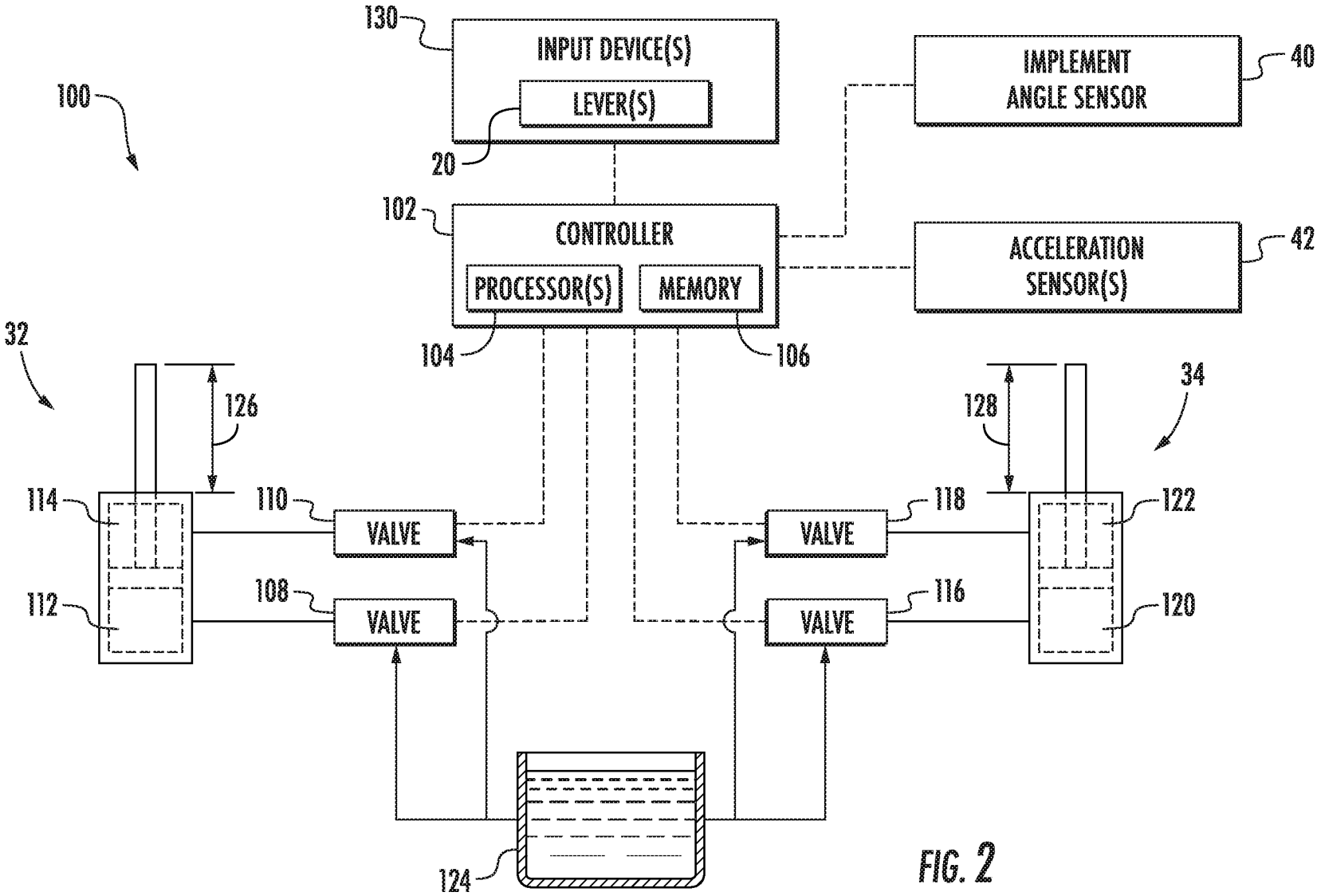
FIG. 2 illustrates a schematic view of one embodiment of a system for controlling an implement of a work vehicle during an implement shake operation in accordance with aspects of the present subject matter.

Referring now to FIG. 2, a schematic diagram of one embodiment of a system 100 for controlling an implement of a work vehicle during an implement shake operation is illustrated in accordance with aspects of the present subject matter. For purposes of discussion, the system 100 will be described herein with reference to the work vehicle 10 shown and described above with reference to FIG. 1. However, it should be appreciated that, in general, the disclosed system 100 may be utilized to control the operation of any work vehicle having any suitable vehicle configuration.

As shown, the system 100 may generally include a controller 102 configured to electronically control the operation of one or more components of the work vehicle 10, such as the various hydraulic components of the work vehicle 10 (e.g., the lift cylinders 32 and the tilt cylinders 34). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as by performing one or more aspects of the method 200 described below with reference to FIG. 4. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

Figure 3:
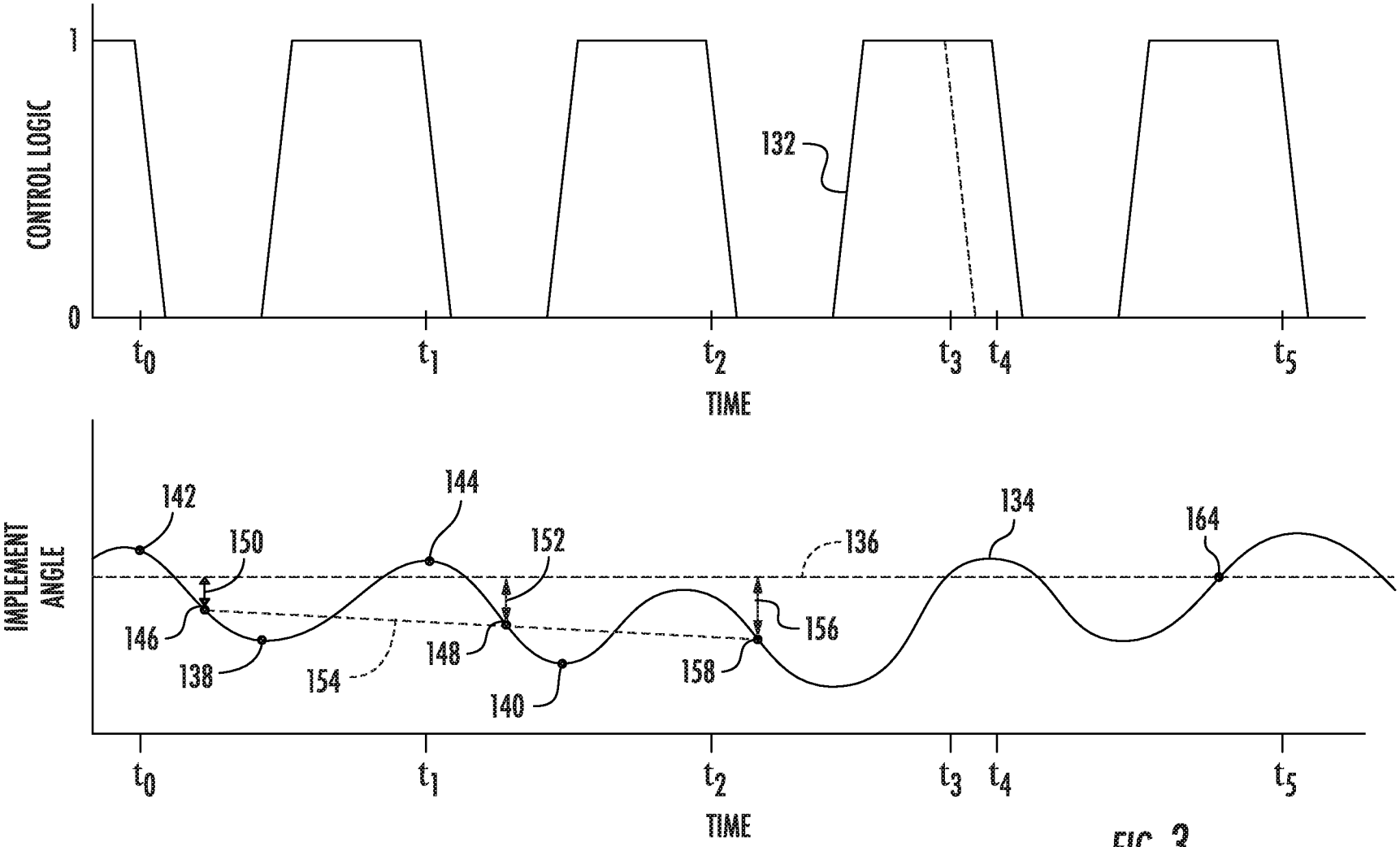
FIG. 3 illustrates an exemplary plot of both the control logic and the implement angle versus time of a portion of an implement shake operation, particularly illustrating an example of adjusting a duty cycle of the implement shake operation.

In several embodiments, the controller 102 may be configured to be coupled to suitable components for controlling the operation of the various actuators 32, 34 of the work vehicle 10. For example, as shown in FIG. 3, the controller 102 may be communicatively coupled to suitable valves 108, 110 (e.g., solenoid-activated valves) configured to control the supply of hydraulic fluid to each lift cylinder 32 (only one of which is shown in FIG. 2). Specifically, as shown in the illustrated embodiment, the system 100 may include a first lift valve 108 for regulating the supply of hydraulic fluid to a cap end 112 of each lift cylinder 32. In addition, the system 100 may include a second lift valve 110 for regulating the supply of hydraulic fluid to a rod end 114 of each lift cylinder 32. Moreover, the controller 102 may be communicatively coupled to suitable valves 116, 118 (e.g., solenoid-activated valves) configured to regulate the supply of hydraulic fluid to each tilt cylinder 34 (only one of which is shown in FIG. 2). For example, as shown in the illustrated embodiment, the system 100 may include a first tilt valve 116 for regulating the supply of hydraulic fluid to a cap end 120 of each tilt cylinder 34 and a second tilt valve 118 for regulating the supply of hydraulic fluid to a rod end 122 of each tilt cylinder 34.

During operation, hydraulic fluid may be transmitted to the valves 108, 110, 116, 118 from a fluid tank 124 mounted on and/or within the work vehicle 10 (e.g., via a pump (not shown)). The controller 102 may then be configured to control the operation of each valve 108, 110, 116, 118 in order to control the flow rate of hydraulic fluid supplied to each of the cylinders 32, 34. For instance, the controller 102 may be configured to transmit suitable control commands to the lift valves 108, 110 in order to regulate the flow of hydraulic fluid supplied to the cap and rod ends 112, 114 of each lift cylinder 32, thereby allowing for control of a stroke length 126 of the piston rod associated with each cylinder 32. Moreover, similar control commands may be transmitted from the controller 102 to the control valves 116, 118 in order to control a stroke length 128 of the tilt cylinders 34. Thus, by carefully controlling the actuation or stroke length 128 of the tilt cylinders 34, the controller 102 may, in turn, be configured to automatically control the way the implement 30 is pivoted or tilted relative to the loader arms 24, thereby allowing the controller 102 to control orientation of the implement 30 relative to the ground. For example, as will be described below, by increasing and decreasing the stroke length 128 rapidly such that the implement 30 is repeatedly moved between the maximum rollback and dump positions, an implement shake operation may be performed to remove dirt, debris, or other materials that have accumulated or otherwise become stuck on the implement 30.

Additionally, as shown in FIG. 2, the controller 102 may be communicatively coupled to one or more input devices 130 for providing operator inputs to the controller 102. Such input device(s) 130 may generally correspond to any suitable input device(s) or human-machine interface(s) (e.g., a control panel, one or more buttons, levers, and/or the like) housed within the operator's cab 18 that allows for operator inputs to be provided to the controller 102. For example, in a particular embodiment, the input device(s) 130 may include the control lever(s) 20 that allow the operator to transmit suitable operator inputs for controlling the various hydraulic components of the work vehicle 10, such as the lift and tilt cylinders 32, 34, thereby permitting the operator to control the position and/or movement of the loader arms 24 and/or implement 30.

In several embodiments, the input device(s) 130 may allow the operator of the work vehicle 10 to provide an input associated with his/her desire to perform an implement shake operation, such as when dirt, debris, or other materials have accumulated or otherwise become stuck on the implement 30. For example, in one embodiment, the operator may be allowed to move the control lever(s) 20 forward or backward several times to indicate his/her desire to perform an implement shake operation. In another embodiment, the operator may indicate his/her desire to perform an implement shake operation by pressing a button (not shown) or toggling a switch (not shown). However, in alternative embodiments, the operator may be allowed to indicate his/her desire to perform an implement shake operation by interacting with any other suitable input device(s) in any other suitable manner.

Moreover, the controller 102 may also be communicatively coupled to one or more sensors for monitoring one or more operating parameters of the work vehicle 10. For instance, as shown in FIG. 2, the controller 102 may be communicatively coupled to the implement angle sensor 40 for monitoring the angle of the implement 30 relative to the loader arms 24. As indicated above, the implement angle sensor 40 may, for example, correspond to a potentiometer positioned between the implement 30 and the loader arms 24. In such an embodiment, as implement 30 is being pivoted relative to the loader arms 24, data from the implement angle sensor 40 may be processed by the controller 102 to determine the angle of the implement 30 relative to the loader arms 24. Moreover, the controller 102 may be communicatively coupled to the acceleration sensor(s) 42 for monitoring the motion/movement of the cab 18. As indicated above, the acceleration sensor(s) 42 may, for example, correspond to an IMU(s) or a gyroscope(s) configured to detect motion or movement of the operator's seat positioned within the cab 18. In such an embodiment, during operation of the vehicle 10, data from the acceleration sensor(s) 42 may be processed by the controller 102 to determine the vibrations or other movement/motion experienced by the operator sitting in the operator's seat.

In several embodiments, during the operation of the work vehicle 10, the controller 102 may be configured to receive an input from the operator of work vehicle 10 associated with his/her desire to perform an implement shake operation. More specifically, in certain instances, dirt, debris, or other materials may accumulate or otherwise become stuck on the implement 30. In such instances, it may be desirable to perform an implement shake operation to remove such material from the implement 30. In this respect, when the operator would like to perform an implement shake operation, the operator may provide an associated input to the controller 102, such as by interacting in a particular manner with the one of the input device(s) 130 (e.g., moving the lever(s) 20 back and forth several times). Thereafter, input device(s) 130 may transmit the operator input associated with the operator's desire to perform an implement shaking operation to the controller 102.

In accordance with aspects of the present subject matter, the controller 102 may be configured to control the operation one or more components of the vehicle 10 such that an implement shake operation is performed. As described above, during the implement shake operation, the implement 30 is pivoted relative to the loader arms 24 between the maximum rollback and dump positions for several cycles. For example, one cycle may correspond to the movement of the implement 30 from the maximum rollback position to the maximum dump position and back to the maximum rollback position. Specifically, in several embodiments, the controller 102 may be configured to transmit suitable control signals to the tilt valves 116, 118. The control signals may, in turn, instruct the tilt valves 116, 118 to regulate the flow of hydraulic fluid supplied to the cap and rod ends 120, 122 of each tilt cylinder 34 in a manner that rapidly increases and decreases the stroke lengths 128 of each cylinder 34. Such increasing and decreasing of the stroke lengths 128 may, in turn, rapidly pivot the implement 30 relative to loader arms 24 between the maximum rollback and dump positions to shake implement 30 in a manner that loosens and/or removes the material accumulated on the implement 30. For example, in one embodiment, the control signals may instruct the tilt valves 116, 118 to rapidly switch between a rod extension configuration and a rod retraction configuration. When in the rod extension configuration, the tilt valves 118 may be configured to increase pressure of the fluid in the cap ends 120 of the tilt cylinders 34 and the tilt valves 118 may be configured to decrease pressure of the fluid in the rod ends 122 of the tilt cylinders 34, thereby increasing the stroke lengths 128 such that the implement 30 is moved toward one of the maximum rollback or dump positions. Conversely, when in the rod retraction configuration, the tilt valves 118 may be configured to decrease pressure of the fluid in the cap ends 120 of the tilt cylinders 34 and the tilt valves 118 may be configured to increase pressure of the fluid in the rod ends 122 of the tilt cylinders 34, thereby decreasing the stroke lengths 128 such that the implement 30 is moved toward the other of the maximum rollback or dump positions.

In several embodiments, the controller 102 may be configured to execute the implement shake operation by controlling the tilt valves 116, 118 via pulse width modulation (PWM). Specifically, the controller 102 may be configured to control the operation of the tilt valves 116, 118 such that valves 116, 118 are rapidly switched between the rod extension and rod retraction configurations for a plurality of cycles. In several embodiments, during a given cycle, the tilt valves 116, 118 may be in a first configuration (e.g., one of the rod extension or rod retraction configurations) for a first portion of the cycle and in a second configuration (e.g., the other of the rod extension or rod retraction configurations) for a second portion of the cycle. For example, in one embodiment, the tilt valves 116, 118 may be switched from the rod extension configuration to the rod retraction configuration and remain the rod retraction configuration for a first portion of the given cycle. Thereafter, the tilt valves 116, 118 may be switched from the rod retraction configuration back to the rod extension configuration and remain the rod extension configuration for a second portion of the given cycle. In this respect, the relative durations of the first and second portions of each given cycle are based on a duty cycle associated with the implement shake operation. In general, the duty cycle may correspond to the percentage of the total time of a given the cycle during which the tilt valves 116, 118 are in the first configuration. As such, the duty cycle may correspond to the duration of the first portion of the cycle divided by the duration of the entire cycle (i.e., the sum of the first and second portions of the cycle). As an example, a duty cycle of forty percent may result the tilt valves 116, 118 being in the first configuration (e.g., the rod retraction position) for the first forty percent of a given cycle and the second configuration (e.g., the rod extension position) for the remaining sixty percent of each cycle. Additionally, the total duration of the entire cycle (i.e., the sum of the first and second portions of the cycle) may be referred to as the period of the cycle. As will be described below, in certain instances, the period of a given cycle may be adjusted (e.g., by increasing or decreasing the duration of the second portion of the cycle) to adjust an average angle of the implement 30 relative to the loader arms 24. In this respect, adjusting the period of the a given cycle may, in turn, effectively adjust its duty cycle.

FIG. 3 illustrates an exemplary plot of the PWM control logic associated with the tilt valves 116, 118 during a portion of an implement shake operation versus time. More specifically, the plot illustrates the tilt valve control logic for a plurality of cycles of an implement shake operation, including a first cycle starting at to and ending at $t_1$ and a second cycle starting at $t_1$ and ending at $t_2$. As will be described below, the plot also illustrates the tilt valve control logic for a third cycle starting at $t_2$ and ending at $t_4$ and a fourth cycle starting at $t_4$ and ending at $t_5$. Moreover, the plot illustrates a first or "off" control configuration corresponding to the rod retraction configuration (e.g., the configuration in which the implement 30 is moved toward the maximum rollback position) and a second or "on" control configuration corresponding to the rod extension configuration (e.g., the configuration in which the implement 30 is moved toward the maximum dump position). Thus, line 132 in FIG. 3 illustrates the valve control logic as a function of time. As shown, at the start of the first cycle, the tilt valves 116, 118 are in the rod extension configuration (e.g., such that the implement 30 is in the maximum dump position). The valves 116, 118 are then switched to the rod retraction configuration for a first portion of the first cycle (e.g., such that the implement 30 is moved toward the maximum rollback position). Thereafter, the valves 116, 118 are switched back to the rod extension configuration for a second portion of the first cycle (e.g., such that the implement 30 is moved toward the maximum dump position) until the first cycle has been completed. The tilt valves 116, 118 are control in the same manner during the second cycle.

Referring again to FIG. 2, the controller 102 may be configured to monitor angle or orientation of the implement 30 relative to the loader arms 24 during the implement shake operation. As described above, the vehicle 10 may include an implement angle sensor 40 configured to capture data indicative of the angle or orientation of the implement 30 relative to the loader arms 24. In this respect, as the implement 30 is moved between the maximum rollback and dump positions during each cycle of the implement shake operation, the controller 102 may be configured to receive data from the implement angle sensor 40. Thereafter, the controller 102 may be configured to process/analyze the received sensor data to determine or estimate the angle of the implement 30 relative to the loader arms 24. For instance, the controller 102 may include a look-up table(s), suitable mathematical formula, and/or algorithms stored within its memory device(s) 106 that correlates the received sensor data to the angle of the implement 30.

Although the angle of the implement 30 relative to the loader arms 24 generally varies (e.g., increases then decreases and subsequently increases) throughout each cycle of the implement shaking operation, there may be an average angle of the implement 30. The average implement angle may, in turn, be indicative of the movement or motion experienced by the vehicle 10 (e.g., the movement/motion felt by the operator in the cab 18) during the implement shake operation. Specifically, there may be a predetermined average implement angle set for the implement 30 such that motion/movement generated by the implement shake operation is acceptable to the operator. In this respect, the duty cycle of the implement shake operation may be set such that the average monitored angle of the implement 30 corresponds to the predetermined average implement angle. However, during the implement shake operation, the average monitored angle of the implement 30 may drift from the predetermined average implement angle (e.g., due to leakage of the hydraulic fluid past the pistons of the tilt cylinders 34). In such instances, the average monitored angle may differ from the predetermined average implement angle, thereby inciting vibrations or other movement/motion the vehicle 10 that are uncomfortable to the operator or otherwise interfere with the operation of the vehicle 10. As will be described below, when the average monitored implement angle differs from the predetermined average implement angle, the controller 102 may be configured to adjust the duty cycle and/or the amplitude of one or more cycles of the implement shake operation (e.g., by adjusting the period of the cycle(s)) such that the average monitored implement angle is returned to the predetermined average implement angle.

In several embodiments, the controller 102 may be configured to determine a first differential between the monitored angle of the implement 30 during a first cycle of the implement shake operation and the predetermined average implement angle. Specifically, in one embodiment, the controller 102 may be configured to analyze the monitored implement angle during the first cycle to identify or determine a minimum angle and a maximum angle of the implement 30 during the first cycle. The controller 102 may then be configured to determine an average angle of the implement 30 relative to the loader arms 24 during the first cycle. Thereafter, the controller 102 may be configured to compare the determined average angle of the implement 30 to the predetermined average implement angle to determine a first differential between the determined average angle of the implement to the predetermined average implement angle for the first cycle. However, in alternative embodiments, the controller 102 may be configured to determine the first differential in any other suitable manner.

Furthermore, in several embodiments, the controller 102 may be configured to determine a second differential between the monitored angle of the implement 30 during a second cycle of the implement shake operation and the predetermined average implement angle. Specifically, in one embodiment, the controller 102 may be configured to analyze the monitored implement angle during the second cycle to identify or determine a minimum angle and a maximum angle of the implement 30 during the second cycle. The controller 102 may then be configured to determine an average angle of the implement 30 relative to the loader arms 24 during the second cycle. Thereafter, the controller 102 may be configured to compare the determined average angle of the implement 30 to the predetermined average implement angle to determine a second differential between the determined average angle of the implement to the predetermined average implement angle for the second cycle. However, in alternative embodiments, the controller 102 may be configured to determine the second differential in any other suitable manner.

The first and second cycles of the implement shake operation may be performed at a nominal duty cycle. In general, the nominal duty cycle may correspond to a predetermined duty cycle that is set for the implement shake operation such that the operator does not experience uncomfortable vibrations and/or the operation of the vehicle 10 is not affected. As such, the nominal duty cycle may be set based on the geometry or other characteristics of the vehicle 10. As will be described below, in certain instances, the nominal duty of the implement shake operation may be adjusted based on data received from the acceleration sensor 42.

Additionally, the controller 102 may be configured to determine an estimated differential between an anticipated average angle of the implement 30 and the predetermined average implement angle during a third cycle of the implement shake operation. In general, the third cycle may be the cycle immediately following the second cycle. Specifically, in several embodiments, the controller 102 may be configured to extrapolate (e.g., linearly extrapolate) the determined first and second differentials to determine the estimated differential for the third cycle. In one embodiment, the controller 102 may be configured to determine the estimated differential at an anticipated angle of the implement 30 at the start of the third cycle. for the third cycle. For instance, the controller 102 may include a look-up table(s), suitable mathematical formula, and/or algorithms stored within its memory device(s) 106 that correlates the first and second differentials to the estimated differential for the third cycle. In another embodiment, the controller 102 may be configured to extrapolate (e.g., linearly extrapolate) the monitored average implement angles of the first and second cycles to determine an anticipated average implement angle for the third cycle. Thereafter, in such an embodiment, the controller 102 may be configured to compare the anticipated average implement angle to the predetermined average implement angle to determine the estimated differential for the third cycle. However, in alternative embodiments, the controller 102 may be configured to determine the estimated differential for the third cycle in any other suitable manner.

FIG. 3 further illustrates an exemplary plot of the monitored angle of the implement 30 relative to the loader arms 24 during a portion of an implement shake operation versus time. More specifically, the plot illustrates the monitored implement angles (indicated solid line 134) relative to a predetermined average implement angle (indicated by dashed line 136) across the first cycle starting at to and ending at $t_1$, the second cycle extending starting at $t_1$ and ending at $t_2$, the third cycle starting at $t_2$ and ending at $t_4$, and the fourth cycle starting at $t_4$ and ending at $t_5$. As shown, the controller 102 may determine controller 102 may be configured to determine the minimum angles 138, 140 and the maximum angles 142, 144 of the implement 30 during the first and second cycles, respectively. The controller 102 may then determine the average angles 146, 148 of the implement 30 during the first and second cycles, respectively. Furthermore, the controller 102 may determine the first and second differentials 150, 152 between the average implement angles 146, 148 during the first and second cycles, respectively, and the predetermined average implement angle 136. Thereafter, the controller 102 may extrapolate (e.g., as indicated by dashed line 154) the first and second differentials 150, 152 to determine the estimated differential 156 between an anticipated average implement angle 158 of the third cycle and the predetermined average implement angle 136.

In accordance with aspects of the present subject matter, the controller 102 may be configured to adjust the duty cycle and/or the amplitude of the third cycle based on the anticipated implement angle and/or the estimated differential of the third cycle. As described above, the duty cycle of the implement shake operation may generally control the average angle of the implement during the implement shake operation. As such, in several embodiments, when estimated differential for the third cycle exceeds a predetermined threshold value (thereby indicating that the average angle of the implement 30 during the implement shake operation has drifted from the predetermined average implement angle), the controller 102 may be configured to control the operation of the tilt valves 116, 118 such that the period of the third cycle is adjusted. Such adjustment may, in turn, be based on the nominal duty cycle (i.e., the duty cycle of the first and second cycles). More specifically, as mentioned above, each cycle of the implement shake operating includes a first portion in which the tilt valves 116, 118 are in one of the rod extension or rod retraction configurations and a second portion in which the tilt valves 116, 118 are in other of the rod extension or rod retraction configurations. In general, during the implement shake operation, duty cycle of the first and second cycles may not be adjusted because there is not enough information to predict how the average implement angle has drifted from the predetermined implement angle. During the third cycle, the controller 102 may be configured to calculate the duty cycle adjustment (e.g., the period adjustment) based on nominal duty cycle and the estimated differential 156. In this respect, to adjust the duty cycle of the third cycle after entering the second portion of the third cycle, the controller 102 may be configured to increase or decrease the duration of the second portion of the third cycle, which adjusts the period of the third cycle. Increasing or decreasing the period of the third duty cycle, in turn, changes the duty cycle of the third period. This adjustment may result in the average implement angle of a subsequent fourth cycle corresponding to the predetermined average implement angle. Alternatively, the controller 102 may be configured to adjust the amplitude of the duty cycle such that the average implement angle of a subsequent fourth cycle corresponding to the predetermined average implement angle.

In the example plot shown in FIG. 3, the estimated differential associated with the third cycle may necessitate an adjustment of the duty cycle at which the valves 116, 118 are being controlled. Moreover, in FIG. 3, it may be assumed that the anticipated average implement angle 158 of the third cycle may require that the tilt valves 116, 118 be in the rod extension or "on" configuration for a greater portion of the third cycle to return the average implement angle of the fourth cycle to the predetermined average implement angle. As mentioned above, the controller 102 cannot decrease the duration of a first portion of the third cycle (i.e., the duration of time in which the tilt valves 116, 118 be in the rod retraction or "off" configuration). In this respect, the controller 102 may increase the duration of the second portion of the third cycle (i.e., the duration of time in which the tilt valves 116, 118 be in the rod extension or "on" configuration) such that the third cycle ends at time $t_4$ instead of time $t_3$. Increasing the duration of the second portion of the third cycle may increase the period of the third cycle such that the third time period ends at time $t_4$ instead of time $t_3$. This, in turn, effectively decreases the duty cycle of the third cycle. Such adjustment may result in an average implement angle 164 of the fourth cycle being returned to the predetermined average implement angle 136, thereby eliminating any uncomfortable movement or motion of the cab 18. In an alternative embodiment, in lieu of adjusting the duration of the second portion of the third cycle (e.g., such that second portion of the third cycle ends at $t_4$ and not $t_3$), the controller 102 may be configured to adjust the amplitude of the first portion of the fourth cycle beginning at $t_3$ (e.g., by adjusting the control logic during the such portion from 0 to a 0.2). Such an amplitude adjustment may similarly result in the average implement angle 164 of the fourth cycle being returned to the predetermined average implement angle 136, thereby eliminating any uncomfortable movement or motion of the cab 18.

Furthermore, the controller 102 may be configured to determine a period or frequency correction factor associated with the duty cycle adjustment. As described above, the adjustment to the period of the third cycle may cause the third cycle to end at a different time (e.g., $t_4$ rather than $t_3$) than it would have if no adjustment had occurred. In this respect, the controller 102 may be configured to determine the period or frequency correction factor based on the amount of time that the second portion of the third cycle was increased or decreased. Based on the period correction factor, the controller 102 may be able to determine when the fourth cycle of the implement shake operation begins. For example, the period correction factor may correspond to a time increment (e.g., the difference between $t_3$ and $t_4$) that is added or subtracted from the time at which the third cycle would have ended if no duty cycle adjustment had occurred.

Additionally, in several embodiments, the controller 102 may be configured to initiate an adjustment to the nominal period or frequency of the implement shake operation when vibrations or other movement/motion is incited in vehicle 10 that is comfortable to the operator or otherwise interferes with the operation of the vehicle 10. For example, in certain instances, the nominal period or frequency of the implement shake operation may incite vibrations in the cab 18 even when the average monitored angle of the implement 30 corresponds to the predetermined average implement angle. In such instances, it may be necessary to adjust the nominal period or frequency of the implement shake operation to quell such vibrations. More specifically, as described above, the vehicle 10 may include one or more acceleration sensors 42 configured to capture data indicative of the movement or motion of the vehicle 10 or certain components of the vehicle 10 (e.g., the cab 18). In this respect, during the implement shake operation, the controller 102 may be configured to receive data from the acceleration sensor(s) 42. Thereafter, the controller 102 may be configured to process/analyze the received sensor data to determine or estimate the vibrations or other movement/motion of the vehicle 10. For instance, the controller 102 may include a look-up table(s), suitable mathematical formula, and/or algorithms stored within its memory device(s) 106 that correlates the received sensor data to the movement/motion of by the vehicle 10. Thereafter, when an parameter (e.g., amplitude/magnitude, frequency, and/or the like) falls outside of an associated predetermined parameter range (thereby indicating that the movement/motion of the vehicle 10 is uncomfortable to the operator or interfering with the operation of the vehicle 10), the controller 102 may be configured to control the operation of the tilt valves 116, 118 such that the nominal period/frequency of the implement shake operation is adjusted.

Figure 4:
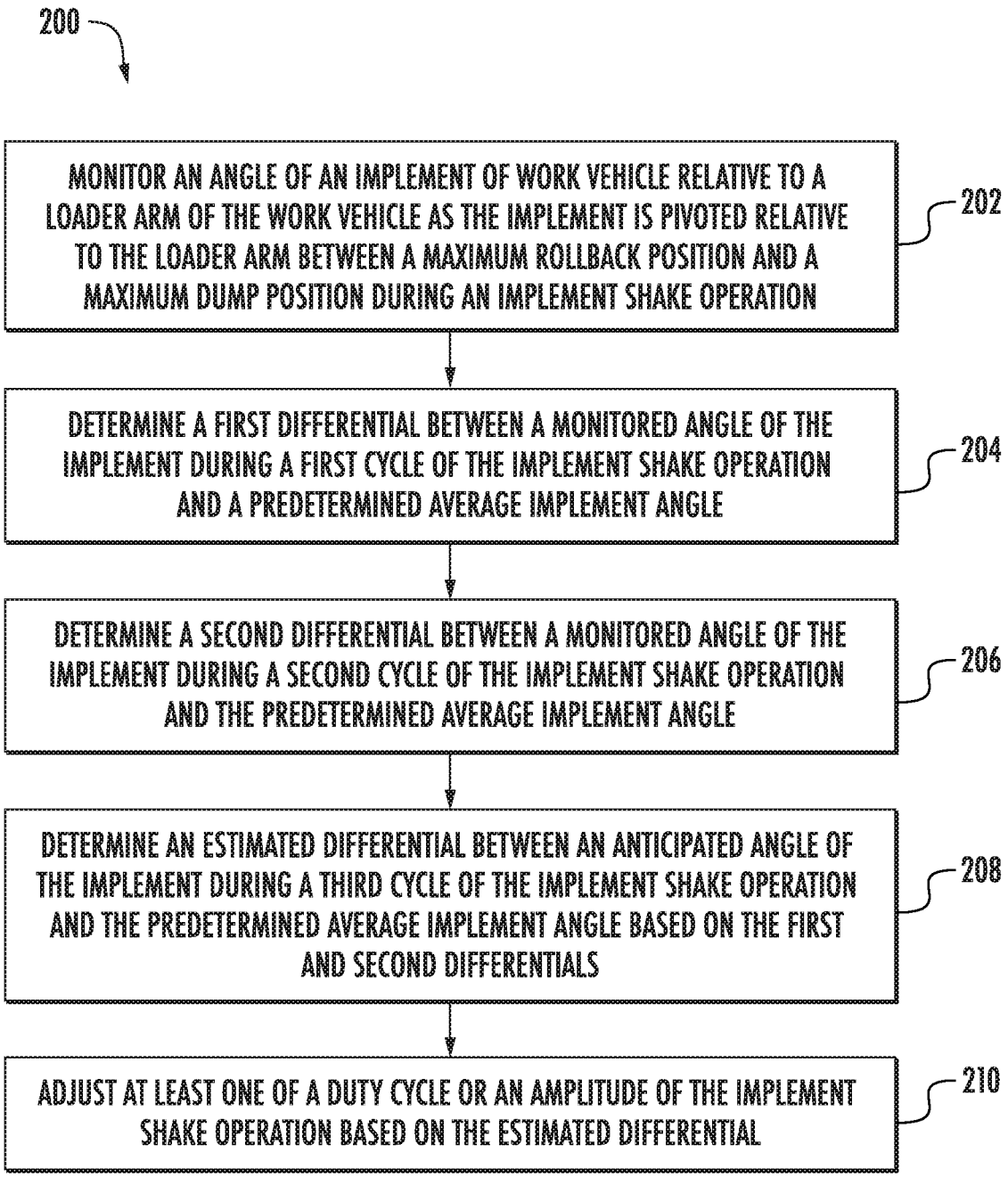
FIG. 4 illustrates a flow diagram of one embodiment of a method for controlling an implement of a work vehicle during an implement shake operation in accordance with aspects of the present subject matter.

Referring now to FIG. 4, a flow diagram of one embodiment of a method 200 for controlling an implement of a work vehicle during an implement shake operation is illustrated in accordance with aspects of the present subject matter. In general, the method 200 will be described herein with reference to the work vehicle 10 and the system 100 described above with reference to FIGS. 1-3. However, it should be appreciated by those of ordinary skill in the art that the disclosed method 200 may generally be implemented with any work vehicles having any suitable vehicle configuration and/or any within system having any suitable system configuration. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 4, at (202), the method 200 may include monitoring, with one or more computing devices, an angle of an implement of work vehicle relative to a loader arm of the work vehicle as the implement is pivoted relative to the loader arm between a maximum rollback position and a maximum dump position during an implement shake operation. For instance, as described above, the controller 102 may be configured to monitor the angle of an implement 30 of a work vehicle 10 relative to the loader arms 24 of the vehicle 10 as the implement 30 is pivoted relative to the loader arms 24 between the maximum rollback and dump positions during an implement shake operation.

Additionally, at (204), the method 200 may include determining, with the one or more computing devices, a first differential between a monitored angle of the implement during a first cycle of the implement shake operation and a predetermined average implement angle. For instance, as described above, the controller 102 may be configured to determine a first differential between a monitored angle of the implement 30 during a first cycle of the implement shake operation and a predetermined average implement angle.

Moreover, as shown in FIG. 4, at (206), the method 200 may include determining, with the one or more computing devices, a second differential between the monitored angle of the implement during a second cycle of the implement shake operation and a predetermined average implement angle. For instance, as described above, the controller 102 may be configured to determine a second differential between a monitored angle of the implement 30 during a second cycle of the implement shake operation and a predetermined average implement angle.

Furthermore, at (208), the method 200 may include determining, with the one or more computing devices, an estimated differential between an anticipated angle of the implement during a third cycle of the implement shake operation and the predetermined average implement angle based on the first and second differentials. For instance, as described above, the controller 102 may be configured to determine an estimated differential between an anticipated angle of the implement 30 during a third cycle of the implement shake operation and the predetermined average implement angle based on the first and second differentials.

In addition, as shown in FIG. 4, at (210), the method 200 may include adjusting, with the one or more computing devices, at least one of a duty cycle or an amplitude of the implement shake operation based on the estimated differential. For instance, as described above, the controller 102 may be configured to adjust the duty cycle and/or the amplitude of the implement shake operation based on the estimated differential via adjusting the period of one or more cycles of the implement (e.g., by increasing or decreasing the duration(s) of the second portion(s) of the cycle(s)).

It is to be understood that the steps of the method 200 are performed by the controller 102 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the controller 102 described herein, such as the method 200, is implemented in software code or instructions which are tangibly stored on a tangible computer readable medium. The controller 102 loads the software code or instructions via a direct interface with the computer readable medium or via a wired and/or wireless network. Upon loading and executing such software code or instructions by the controller 102, the controller 102 may perform any of the functionality of the controller 102 described herein, including any steps of the method 200 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A system for controlling a work vehicle implement during an implement shake operation, the system comprising:

a loader arm;

an implement coupled to the loader arm, the implement configured to pivot relative to the loader arm between a maximum rollback position and a maximum dump position;

a sensor configured to capture data indicative of an angle of the implement relative to the loader arm; and a controller communicatively coupled to the sensor, the controller configured to:

monitor the angle of the implement relative to the loader arm as the implement is pivoted relative to the loader arm during the implement shake operation based on data received from the sensor;

determine a first differential between a monitored angle of the implement during a first cycle of the implement shake operation and a predetermined average implement angle;

determine a second differential between a monitored angle of the implement during a second cycle of the implement shake operation and a predetermined average implement angle;

determine an estimated differential between an anticipated angle of the implement during a third cycle of the implement shake operation and the predetermined average implement angle based on the first and second differentials, the third cycle occurring after the first and second implement cycles; and adjust at least one of a duty cycle or an amplitude of the implement shake operation based on the estimated differential.

2. The system of claim 1, wherein the controller is further configured to:

determine a minimum angle of the implement and a maximum angle of the implement during the first cycle;

determine an average angle of the implement during the first cycle based on the minimum and maximum angles;

determine a minimum angle of the implement and a maximum angle of the implement during the second cycle; and determine an average angle of the implement during the second cycle based on the minimum and maximum angles.

3. The system of claim 2, wherein the controller is further configured to:

compare the average angle of the first cycle and the predetermined average implement angle to determine the first differential for the first cycle; and compare the average angle of the second cycle and the predetermined average implement to determine the second differential for the second cycle.

4. The system of claim 1, wherein the controller is further configured to determine the estimated differential at a start of the third cycle.

5. The system of claim 1, wherein the controller is further configured to extrapolate the determined first and second differentials to determine the estimated differential.

6. The system of claim 1, wherein the controller is further configured to determine a period correction factor associated with a period of the third cycle based on the adjustment to the duty cycle.

7. The system of claim 6, wherein the controller is further configured to determine when a fourth cycle of the implement shake operation begins based on the period correction factor, the fourth cycle occurring after the third cycle.

8. The system of claim 1, further comprising:

an acceleration sensor configured to capture data indicative of motion of the work vehicle, the controller is further configured to determine a parameter of the movement of the vehicle based on the received sensor data and initiate an adjustment of a period of the implement shake operation when it is determined that parameter of the motion has fallen outside of a predetermined parameter range.

9. The system of claim 8, wherein the acceleration is configured to capture data indicative of vibrations of a cab of the work vehicle.

10. The system of claim 1, wherein the implement comprises a bucket.

11. A method for controlling an implement of a work vehicle during an implement shake operation, the implement being pivotably coupled to a loader arm of the work vehicle, the method comprising:

monitoring, with one or more computing devices, an angle of the implement relative to the loader arm as the implement is pivoted relative to the loader arm between a maximum rollback position and a maximum dump position during the implement shake operation;

determining, with the one or more computing devices, a first differential between a monitored angle of the implement during a first cycle of the implement shake operation and a predetermined average implement angle;

determining, with the one or more computing devices, a second differential between a monitored angle of the implement during a second cycle of the implement shake operation and the predetermined average implement angle;

determining, with the one or more computing devices, an estimated differential between an anticipated angle of the implement during a third cycle of the implement shake operation and the predetermined average implement angle based on the first and second differentials, the third cycle occurring after the first and second cycles; and adjusting, with the one or more computing devices, at least one of a duty cycle or an amplitude of the implement shake operation based on the estimated differential.

12. The method of claim 11, wherein:

determining the first differential comprises:

determining, with the one or more computing devices, a minimum angle of the implement and a maximum angle of the implement during the first cycle; and determining, with the one or more computing devices, an average angle of the implement during the first cycle based on the minimum and maximum angles; and determining the second differential comprises:

determining, with the one or more computing devices, a minimum angle of the implement and a maximum angle of the implement during the second cycle; and determining, with the one or more computing devices, an average angle of the implement during the second cycle based on the minimum and maximum angles.

13. The method of claim 12, wherein:

determining the first differential further comprises comparing, with the one or more computing devices, the average angle of the first cycle and the predetermined average implement angle to determine the first differential; and determining the second differential further comprises determining, with the one or more computing devices, the average angle of the second cycle and the predetermined average implement to determine the second differential.

14. The method of claim 11, wherein determining the estimated differential comprises determining, with the one or more computing devices, the estimated differential at a start of the third cycle.

15. The method of claim 11, wherein determining the estimated differential comprises extrapolating, with the one or more computing devices, the determined first and second differentials.

16. The method of claim 11, further comprising:

determining, with the one or more computing devices, a period correction factor associated with a period of the third cycle based on the determined adjustment to the duty cycle.

17. The method of claim 16, further comprising:

determining, with the one or more computing devices, when a fourth begins based on the period correction factor, the fourth cycle occurring after the third cycle.

18. The method of claim 11, further comprising:

receiving, with the one or more computing devices, sensor data indicative of motion of the work vehicle;

determining, with the one or more computing devices, a parameter of the motion based on the received sensor data; and when the determined parameter of the motion falls outside of a predetermined parameter range, initiating, with the one or more computing devices, an adjustment of a period of the third cycle.

19. The method of claim 18, wherein the sensor data is indicative of vibrations of a cab of the work vehicle.

20. The method of claim 11, wherein the implement comprises a bucket.

* * * * *